United States Patent [19]

Peppard

[11] 4,076,244

[45] Feb. 28, 1978

[54] PLAYING PIECE FOR TABLE SOCCER

[76] Inventor: Eugene Lee Peppard, 3537-46th Northeast, Seattle, Wash. 98105

[21] Appl. No.: 724,474

[22] Filed: Sep. 20, 1976

[51] Int. Cl.[2] ..... A63F 7/10

[52] U.S. Cl. ..... 273/85 D

[58] Field of Search ..... 273/85 C, 85 D

[56] References Cited

U.S. PATENT DOCUMENTS 3,920,244 11/1975 Kaiser ..... 273/85 D

*Primary Examiner*—Anton O. Oechsle

[57] ABSTRACT

A playing piece for table soccer or a similar game wherein the playing piece is positioned for rotational movement about a horizontal axis as well as linear movement along the axis a predetermined distance above the table playing surface and is utilized by appropriate movement to control the movement of a ball or similar object across the table surface toward the opponent's goal. The playing piece includes relatively vertical planar side surfaces to allow lateral passage of the ball from one playing piece or position to another as well as configurated and tapered front and back surfaces on the foot joined by a uniformly curved bottom portion which permits the piece to be used to stop or pin the ball and then propel it in a rapid fashion towards the opponent's goal.

4 Claims, 11 Drawing Figures

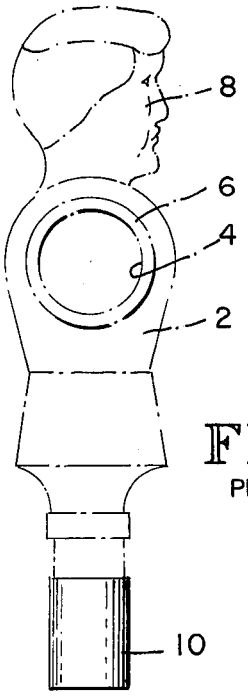
FIG. 1
PRIOR ART
FIG. 2
PRIOR ART
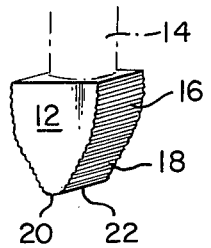
FIG. 3
PRIOR ART
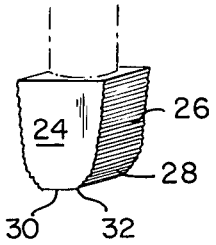
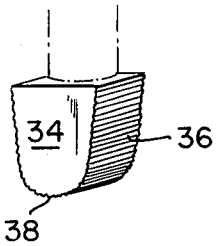
FIG. 4
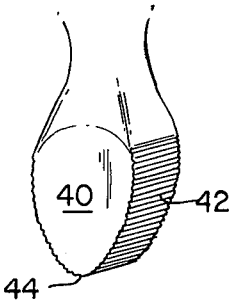
FIG. 5
PRIOR ART
FIG. 6
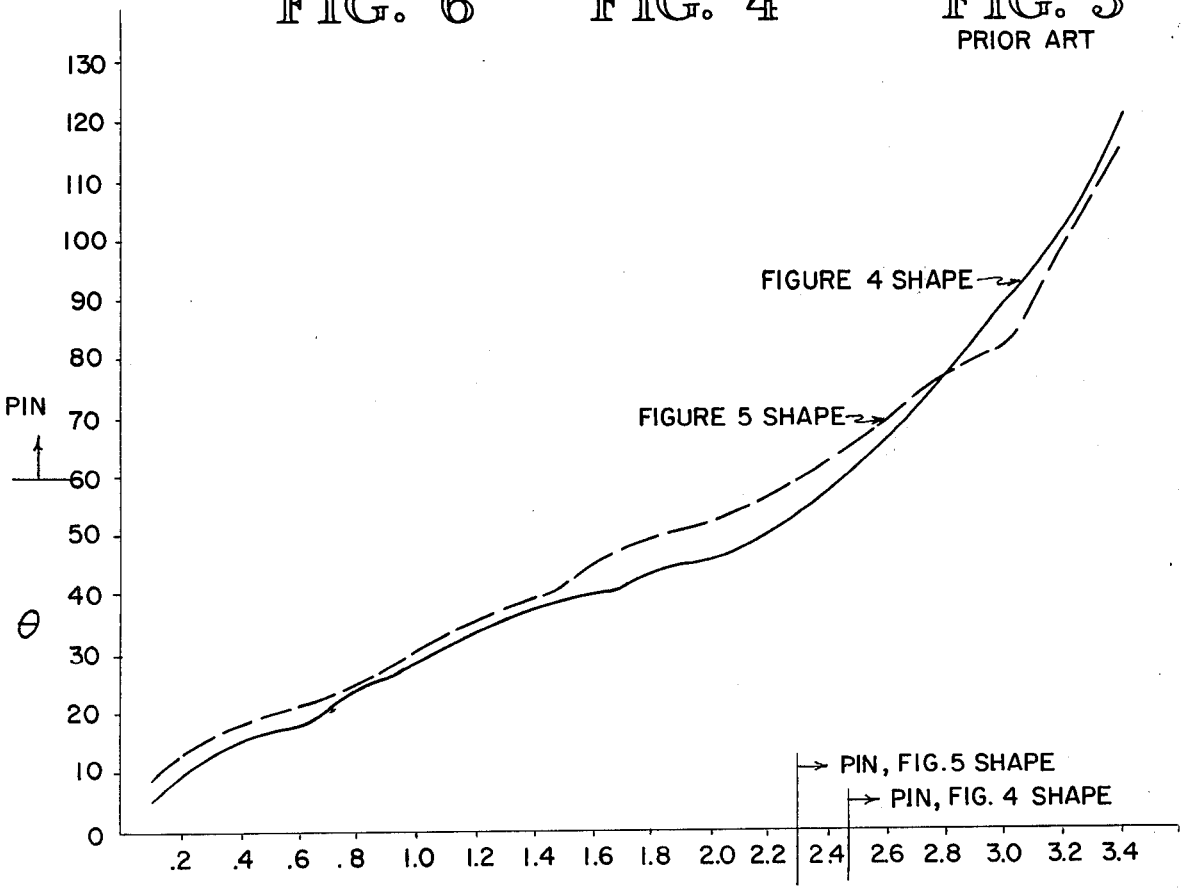

PLAYING PIECE FOR TABLE SOCCER

BACKGROUND OF THE INVENTION

The present invention, although dealing in the broad sense with a playing piece is particularly directed toward the game of table soccer or foos ball. The foos ball game apparently originated either in Europe or the Orient, the historical development being somewhat clouded, where a plurality of sticks or other shaped pieces were secured to an axially movable rod above a table surface for rotational and axial movement therewith. A ball was placed upon the table surface and opposing players having an equal number of game pieces attempted to hit the ball driving it towards the opponent's goal. Broadly speaking, the game represents field soccer. Over the years, the game, much as have other games, became more and more popular, the elements were improved and refined and the competition became very stiff. As the competition became greater and the human skills improved, it became important to have equipment to enable the player contact with the ball by means of an object secured to a horizontal rod to control the ball. As the game has evolved, the element or piece mounted to the rod became configured such that only the lower portion or foot of the element contacted the ball.

For purposes of esthetics, as well as attempting to improve the popularity of the game, the upper portion of the playing piece has adopted any one of numerous configurations, some of them attempting to resemble or approximate a human player whereas others have become very stylized or modernistic in configuration. While the overall shape of the player is not important to the present application, it is important to recognize that the image presented does, in fact, probably assist in the popularity of the game and that the shape of the ball contacting or foot portion is extremely critical.

As the competition has grown and, in fact, with the introduction of tournaments with the total payout and the several hundred thousand dollars, the particular shape of the foot, i.e. the primary ball control element, has become more and more critical and tends to dictate the way the game is played.

As a result of the requirements for more accurate control, the configuration has gradually changed from a foot which was essentially a solid rectangular block to a foot which was slightly tapered at the bottom to provide greater contact when the playing piece was not in its vertical position and yet retained vertical sides to allow lateral passage on the table for better approaches to the goal. Another development, as will be described hereinafter, included rounding the front and back lower corners of the foot while retaining a flat surface on the bottom and maintaining flat side surfaces to allow lateral passing. Models of the foot which are currently utilized in commercial tables include one which is essentially egg shaped when seen in cross-section, one that is partially scooped or hollowed on the front portion and having an analogous configuration on the backside, resulting in a configuration very similar to a spoon. Again, the sides are maintained flat and vertical for lateral passing.

It is important to remember that the main idea of the game is to control the ball and to move it in to the opponent's goal. In order to do this, one must avoid the opponent's playing pieces which are used in the defensive manner while maintaining the capability of careful and accurate shots directed toward the goal. As is readily apparent, the ball will not always be in the center of the table, i.e. the line that extends between the goals, allowing direct shots. Therefore, the foot of the player must have a surface which allows the players to place a shot which will traverse the table at an angle and either ricochet off the wall or move directly to the goal at the angle. It is further important that when a player does not have control of the ball such that an accurate shot may be made, he must be able to stop the movement of the ball and place the ball in a position for an accurate shot. It is the ability to control the ball, make accurate shots, and further the ability to impede the shots of one opponent that allows one to win in this highly competitive game.

With the above noted problems and prior art in mind, it is an object of the present invention to provide a game playing piece in particular for use with table soccer, wherein the piece has greatly improved playing characteristics in that it has a configuration and shape providing far greater control for the player.

It is another object of the present invention to provide a game playing piece for tournament soccer wherein the so-called "pin-zone" is of sufficient size without being so large that it inhibits the play by reducing the strike zone.

It is yet another object of the present invention to provide a game playing piece wherein the particular configuration of the foot gives the player far greater control over the ball on the table.

It is still a further object of the present invention to provide a game piece having a foot configuration and surface such that the maximum percentage is an effective playing surface.

BRIEF DESCRIPTION OF THE DRAWINGS

FIG. 1 is an elevational view of a playing piece representative of the prior art in the game of table soccer or foos ball.

FIG. 2 is a perspective view of a foot such as was used in the prior art of the game of foos ball.

FIG. 3 is a perspective view of yet another foot such as had been used in the prior art.

FIG. 4 is a perspective view of the configuration of the inventive foot for a foos ball player.

FIG. 5 is a perspective view of a foot of a player currently in use.

FIG. 6 is a graphical comparison between the area of contact between the foot of the foos ball player and the foos ball itself, with respect to the foot as shown in FIG. 4 and FIG. 5.

DETAILED DESCRIPTION OF THE DRAWINGS

Figure 7:
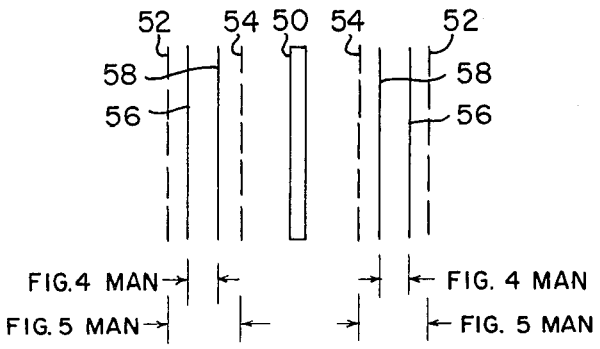
FIG. 7 is a plan view showing the difference in the width of the prior art strike zones of the feet of FIGS. 4 and 5.

As seen in FIG. 1, the playing piece consists primarily of a body portion 2, which is secured to a horizontal playing rod 4 which passes through an opening 6 in the upper portion of the main body. It is to be understood that although this description deals with only one player, there are several rods and players on each game table. Depending upon the preference of the manufacturer, there is applied a human like head 8 or similar configurated top portion. The most important and the critical portion of the player is the foot generally designated by 10, which may be interconnected with the body portion by any one of several means, but usually the entire body including the head and foot is made in one single mold.

As seen in FIG. 2, the prior art foot has a flat side portion 12 interconnected to the leg or lower portion of the body 14, and a ribbed face portion which has a substantially vertical upper section 16, and a tapered lower section 18 terminating in a substantially horizontal bottom 20. As will be explained in greater detail hereafter, this configuration presents a number of complications with respect to the player. In one situation, the flat surface 18 presents a large area and therefore, a wide zone whereat the ball will be pinned, and the line of intersection between the flat surface 20 and the flat surface 18, designated as 22, provides an area wherein the player, unless he is extremely accurate, cannot have proper control.

Referring now to FIG. 3, another prior art device, the flat side surface is designated as 24, which is, as mentioned hereinabove, used for passing the ball laterally across the table. The actual playing surface consists of a slightly tapered but substantially vertical face portion 26, curving through an arc at 28 to a flat bottom portion 30. As was indicated with respect to the playing piece shown in FIG. 2, this does not provide an adequate pinning zone, and further the line of demarcation between the curved surface 28 and the flat surface 30, herein designated as 32, likewise presents a line of intersection and thus a line of minimal contact.

The foot as shown in FIG. 4, as briefly explained hereinabove, provides extremely good control characteristics. It includes the flat side surface 34, and a playing surface 36 which, although slightly tapered, is flat and curves through a smooth, i.e., uniform, arc 38 to the reverse side which is identical to the portion 36. As will be obvious, the configuration of the foot of FIG. 4 is symmetrical when viewed along a line extending upwardly through the center of the control rod, has a curved surface which provides, as will be explained in detail hereafter, a definite pin zone, and yet provides a surface which is maximized for the striking or forward motion, the most critical portion of the game.

The foot as seen in FIG. 5 is almost egg-shaped when seen in profile. It too, includes a flat side portion 40 for passing and then a curved face portion starting with the upper area 42, tapering to a narrow curved bottom portion 44 and then upwardly again, which as explained hereinabove appears as an egg in profile. This foot, although offering improved characteristics over the prior art, as shown in FIGS. 2 and 3, has a distinct disadvantage and drawback in that its outwardly flared face portion extending from 44 to 42 does, as will be explained with respect to FIGS. 6 and 7, cause a larger pin zone which many times is troublesome.

In FIG. 6, there is graphically shown a comparison between the feet of FIGS. 4 and 5. The graph compares the angle at which the body of the player, i.e. the line which passes through the center of the control rod and the foot, has with respect to the vertical when it contacts the ball which is the designated distance in inches from that position immediately below the player. As can be seen, the configuration of the foot of the player makes a great deal of difference with respect to the handling or response of the ball. In general terms, the ball will be pinned, i.e. stopped, from any motion at all when the playing piece assumes an angle of 60° or greater, to the vertical since at this point and beyond, the primary vector of motion will be directed downwardly into the table and will thus not cause any sideward or forward/reverse motion. Looking then at the graphical representation in FIG. 6, and utilizing the 60° angle as the inception of pin, it can be seen that the foot of FIG. 5 begins its pin zone at approximately 2.3 inches from the center line, whereas the pin zone of the FIG. 4 figure begins closer to 2.5 inches. Said in another way, the shape of the FIG. 4 foot has a greater strike zone — i.e. that zone wherein the player can be utilized to propel the ball toward the opponent's goal. It may seem inconsequential that the difference is no more than 2/10ths of an inch; and yet when the professional competitors are utilizing their full skill, this difference is highly relevant. It must be remembered that as the pin zone becomes greater the effective strike contact becomes less.

Referring now to FIG. 7, the same comparison can be made. Utilizing as a reference point, the horizontal control rod designated in this figure as 50, it can be seen that the pin zone for the foot configuration of FIG. 5 extends from lines 52 to 54 on both sides of the center line. Whereas the configuration of the foot shown in FIG. 4 has a pin zone which extends from the lines 56 to 58, a significant impact when, as stated above, just a small change makes a significant difference in the player's ability to control the ball.

Figure 8:
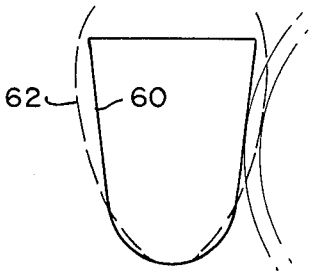
FIG. 8 is a comparative elevational representation showing the differential ball contact utilizing the feet of FIGS. 4 and 5.
Figure 9:
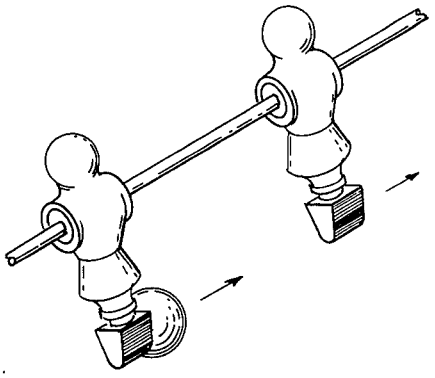
FIG. 9 is an isometric view depicting the utilization of the foot of FIG. 4 in a lateral passing situation.
Figure 10:
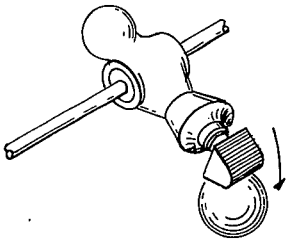
FIG. 10 is a perspective view of a player incorporating the foot of FIG. 4 in a pinning situation.
Figure 11:
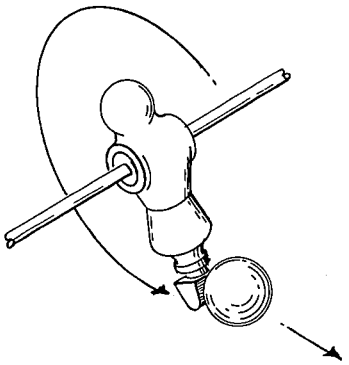
FIG. 11 is a perspective view of a player utilizing the foot of FIG. 4 in a shooting situation.

Perhaps the comparison between the two foot configurations is best illustrated in FIG. 8, wherein the profile of the foot of FIG. 4 is shown in solid lines designated as 60. It can be seen that the upper portion of the face is substantially planar and angles slightly inwardly toward the base then curves inwardly toward the base to terminate in a sharp bottom curve to blend with a surface of the same configuration on the opposite side of the foot. The profile of the foot of FIG. 5 having a convexly curved front and back and an arcuate bottom is shown in dotted lines designated as 62. The relative contact between the foot of each of the two men and the ball when the man is in its normal or vertical position is shown with the ball designated in phantom in the two contact positions. It is obvious from this view that the configuration of the foot greatly varies the size of the hit or strike zone. To put the entire problem in better perspective, FIGS. 9 through 11 depict the three basic play conditions of the game of foos ball or table soccer. It is to be understood that this does not in any way indicate all the various combinations which are possible, but certainly the three which are necessary and which are illustrative.

The figure in FIG. 9 is using the horizontal side surface of the foot to pass or lateral the ball across the table to another one of his men who has a better shot at the goal. Following the pass, the man, as seen in FIG. 10, pins the ball or stops its motion so that it can have a straight and accurate shot. It is obvious that there is a sideward vector on the ball; when it is hit by the man, it will tend to be propelled at an angle instead of directly forward from the man. Sometimes, as professional or competitive players will indicate, it is necessary to have an angle approach to the goal to avoid the opponent's defense and this is done using the combination of movements but is not critical to the present application. Following the stop or pin of FIG. 10, the player then is rotated about the horizontal control rod to get a solid direct hit on the ball or strike which drives the ball at great speed toward the goal.

Thus as can be seen, the present invention provides a foot on a competitive table soccer player which gives the player the necessary control for a strong competitive game. The foot has the necessary elements required to assure that the player has accurate control of the man and the ball at all times. As designated above, it is important that there be a zone of pin, namely that zone wherein the player can, in fact, stop the ball's motion and set it up for a hard strike or shot at the goal. It is important that this zone be large enough to allow a pin when required, but it should not be so large as to interfere with the strike zone. On the opposing side of the approach, the pin zone should not be so narrow that it requires extreme accuracy and concentration to execute the pin, thus detracting from the speed of the game. It is important to note that when one is attempting to score a goal, it is not only necessary that he have control, but also that he outthink or move more quickly than his opponents; so therefore, it is necessary to quickly pin the ball and then likewise move it forward again.

What is claimed is:

1. A playing piece for use in a table game such as table soccer wherein a ball is propelled and controlled by the playing piece comprising:

an elongated body element, an upper portion designed to be secured to a horizontal rod for movement about a horizontal axis with said rod, a lower ball contacting foot portion including front and back portions which are substantially planar and converge toward the bottom whereat they are tangential with and joined by a smooth continuous uniform curve, whereby the player is assured of good control and a maximized strike surface and strike zone while retaining a definite and significant pin zone.

2. A playing piece as in claim 1, wherein the front, back and joining lower surfaces include parallel ridges covering substantially the entire surface whereby the contact between the ball and the piece will assume positive control.

3. A playing piece for use with table soccer or the like including a ball contacting foot portion which is substantially rectangular when seen from the front and rear, has substantially planar front and rear surfaces to provide a maximized strike zone and substantially planar and substantially parallel side surfaces, the front and rear surfaces converging toward the bottom of the piece and joined by a smooth continuous uniform curved surface tangential to the front and rear surfaces, said curved surface providing a definite and significant pin zone.

4. A playing piece as in claim 3, wherein the front, rear and joining portions include textured surfaces.

* * * * *